United States Patent [19]

Dionne

[11] Patent Number: 4,773,285

[45] Date of Patent: Sep. 27, 1988

[54] AUTOMATIC DECAPPER

[75] Inventor: Raymond J. Dionne, Sherwood Park, Canada

[73] Assignee: Labatt Brewing Company Limited, London, Canada

[21] Appl. No.: 792,532

[22] Filed: Oct. 29, 1985

[51] Int. Cl.[4] ..... B67B 7/16

[52] U.S. Cl. ..... 81/3.2; 81/3.27; 81/3.32

[58] Field of Search ..... 81/3.2, 3.25, 3.27, 81/3.31–3.33, 3.36–3.39, 3.55–3.57; 53/381 R, 381 A; 198/480.1, 481.1, 463.4

[56] References Cited

U.S. PATENT DOCUMENTS

| | | | |
|---|---|---|---|
| 1,551,331 | 8/1925 | Risser | 198/480.1 |
| 2,386,152 | 10/1945 | Wahl | 81/3.2 X |
| 2,747,443 | 5/1956 | Vandre | 81/3.2 |
| 2,985,283 | 5/1961 | Carter | 198/481.1 X |
| 3,037,407 | 6/1962 | MacLaren | 81/3.2 |
| 3,216,289 | 11/1965 | Lyman | 81/3.2 |
| 3,355,856 | 12/1967 | Randrup | 81/3.2 X |
| 3,545,174 | 12/1970 | Randrup | 53/381 A |
| 3,651,751 | 3/1972 | Randrup | 81/3.2 X |
| 3,870,175 | 3/1975 | DiIanni | 81/3.2 X |
| 3,914,920 | 10/1975 | DiIanni | 53/381 A |
| 4,070,854 | 1/1978 | Marino | 81/3.2 X |
| 4,363,204 | 12/1982 | Ohude et al. | 53/381 A |

FOREIGN PATENT DOCUMENTS

| | | |
|---|---|---|
| 2413037 | 2/1975 | Netherlands . |
| 785481 | 5/1968 | Canada . |
| 1316252 | 5/1973 | United Kingdom . |

*Primary Examiner*—Debra Meislin

*Attorney, Agent, or Firm*—Fisher, Christen & Sabol

[57] ABSTRACT

The present invention relates to a decapping machine adapted to receive capped bottles and operable to decap bottles so received. The machine comprises a decapping station wherein individual capped bottles are securely positionable in bottle decapping relation with an assembly comprising a lever arm rotatable about a pivot. An anvil is secured to the lever arm in spaced apart relation from the pivot. The assembly is located relative to the station such that on rotation of the arm about the pivot, the anvil is moveable from a starting position slightly below but vertically aligned with the location of a peripheral portion of a cap borne in secured frictional engagement on a bottle when same is securely positioned at the decapping station, to a second position above the first position and lying along an arcuately divergent path from a longitudinal center line of the bottle, whereby during the anvil's traverse of that path, the anvil contacts the peripheral edge of the bottle cap and urges the cap out of secured frictional engagement with the bottle.

6 Claims, 2 Drawing Sheets

AUTOMATIC DECAPPER

FIELD OF THE INVENTION

The present invention relates to a novel bottle decapping apparatus of the type useful in removing bottle caps from crown-capped bottles. In particular the apparatus of the present invention is useful in removing bottle caps of the type having a generally flat portion which seals the opening of the bottle, and a downwardly depending skirt portion extending from the circumference of the generally flat portion, the skirt being constructed of a deformable, substantially non-elastic material, which skirt may be crimped so as to engage the bottle neck in secured frictional engagement.

BACKGROUND OF THE INVENTION

In the bottled beverage industry, there is a significant segment thereof which, for reasons of economy and/or by virtue of governmental regulation, utilizes refillable bottles. Regardless of the reason underlying such usage, it is well known that during the production and packaging of a beverage any number of quality control problems can arise which may necessitate decapping the bottle, draining its contents and preparing it for reuse. Such problems include for example the post-packaging discovery that the beverage itself is defective by virtue of, for example, an off-flavour or some inherent instability which would reduce its shelf life. The problem might also stem from the improper application of a label or be due to low fills, for example. The capped bottles were, historically, decapped by hand, in an operation which was very slow, tedious in the extreme, and costly. In response to the need for a better means to decap bottles, a number of automatic machines have been developed. Some of these machines are adapted to decap individual bottles, one at a time, while others are adapted to handle the decapping of several bottles simultaneously. Still other such machines combine one or more ancilliary functions with the bottle decapping operation, such as for example combining the decapping and uncasing operations, or the uncapping and draining functions. In any case, and at least in as far as the bottle decapping operation per se, is concerned, these machines are basically of one of two types: (1) those which operate by rotating the screw-on type of cap off of the threaded bottle neck; and, (2) those which operate by prying the peripheral edge of the crimped skirt of more traditional bottle caps out of frictional engagement with the abutments arranged on the bottle neck. Numerous examples of the first type of machine are disclosed in U.S.A. Pat. Nos. 7; 1773,803,795; 3,844,093; 3,845,605; 4,030,271; 4,172,397; 4,178,732; and, 4,265,071.

A variety of machines of the second type have also been suggested. One such machine is disclosed in British Patent Specification No. 1,316,252 which teaches an apparatus for opening and emptying filled bottles sealed with a crown cap. The apparatus therein disclosed includes a decapping station wherein the bottle is supported in a horizontal position in axially aligned relation with a piston-actuated ram. The bottle cap, borne on the neck of the horizontally-positioned bottle, is passed through a close tolerance flaring die. When the piston-actuated ram strikes the centre of the cap, the downwardly depending peripheral edges of the cap flare to the extent that the diameter of the cap as measured around the peripheral edges thereof exceeds the diameter of the close tolerance flaring dye. The continued action of the ram causes the peripheral skirt to continue to flare until such time as the cap is released from the bottle neck abutment. The uncapped bottle then falls under the influence of gravity into an inverted position whereupon the liquid inside the bottle drains away. The apparatus required is relatively complex, requiring means to locate the bottle in a horizontal position and subsequently receive the bottle in its decapped state. Perhaps more importantly, the shock on the bottle due to the action of the plunger is obviously quite severe, and potentially damaging to the glass.

The general principle of operation of the apparatus disclosed in the above-mentioned U.K. patent specification is very similar to the principle of operation of a machine disclosed in German Offenlegungsschrift No. 2413037. The apparatus disclosed in the German document differs from the British device in that it does not require a complicated mechanism for positioning the bottles. In addition, the flairing dies, as well as the piston-actuated ram, are adapted to receive a plurality of bottles in simultaneous decapping relation with the apparatus.

Another apparatus of the above-mentioned second type is disclosed in Canadian Patent No. 785,481. This apparatus comprises a horizontal conveyor for delivering the capped, filled bottles to a decapping station. At the decapping station there is provided a wheel rotating in a vertical plane above the horizontal conveyor, that wheel being provided with a plurality of radially spaced apart hooks arranged about the circumferance of the wheel. The rotation of the wheel is synchronized with the motion of the conveyor, and the hooks depending from the periphery of the wheel operate to rip the caps off bottles passing beneath the wheel on the conveyor. As with apparatus of the type disclosed in the above-mentioned British patent specification, the apparatus disclosed in this Canadian patent is disadvantageous in that the violent way in which the cap is removed results, in many cases, in the sealing ring or abutment on the mouth of the bottle, becoming chipped during the decapping operation.

Yet another bottle decapping apparatus is disclosed in U.S. Pat. Nos. 3,914,920 and 3,870,175. In operation, the decapping apparatus must be carefully axially aligned with the capped bottle. The bottle is raised into a position wherein a fixed portion of the decapping apparatus engages the shoulders of the bottle while an internal, moveable portion of the decapping apparatus engages the lower portions of the cap's peripheral skirt in secured abutting relation. The moveable internal portion, acting in a manner similar to a gear or fly-wheel puller, is caused by the rotation of a threaded shaft to move relative to the stationary portion of the decapper and away from the bottle such that the bottle cap is pried vertically from the abutment or sealing ring located uppermost on the bottle neck. A somewhat similar apparatus is disclosed in U.S. Pat. No. 4,363,204. Such devices are rather complex, extremely costly and require a great deal of precision in their operation, which makes them difficult to maintain under plant conditions.

Another bottle decapping apparatus is disclosed in U.S. Pat. No. 4,070,854. The apparatus therein disclosed seeks to avoid chipping of the bottle necks by acting entirely on the cap to be removed, rather than on the bottle itself. This apparatus, however, like many of those discussed above, is relatively complex and requires that a number of mechanical actions to take place in a very precise, synchronized manner.

Accordingly, it can be readily appreciated that bottle neck chipping and even more severe forms of breakage remains a problem in the prior art. The only solutions offered to date have entailed complex and costly machinery that is highly susceptible to wear and other maintenance problems.

It will be understood that major problems arise when bottle chipping is not readily apparent since, in such cases, the damage is not generally detected and the bottle may be recycled, which in turn can result in damage to the automatic filling equipment, e.g. such as the sealing washers being ripped off or torn by the chipped bottleneck. This further exacerbates the original problem since damage to the seal on the bottling equipment can cause further inaccuracy in bottle filling and serves only to produce more improperly filled bottles which must then be recycled in their turn.

It is clearly apparent that automated decapping machines which utilize a lever action to effect decapping have carried over from the manually-operated, hand-held bottle opener design, the operating principle whereby the cap is levered off the bottle by engaging a portion of the peripheral edge of the cap's depending skirt with decapping anvil means, which might take the form of, for example, a hook and utilizing a diametrically opposed portion of the cap as a fulcrum across which to apply decapping leverage. (See, for example, U.S. Pat. Nos. 2,747,443; 3,216,289; 3,355,856; and 3,651,751.)

A less common variant of the same operating principle utilizes as a fulcrum, the side of the bottle neck opposite the point at which the anvil contacts the peripheral edge of the cap (see U.S. Pat. No. 2,386,152). In the operation of both of the above-described variants, the anvil's motion necessarily follows an arcuate path towards the longitudinal axis of symmetry of the bottle during the anvil's decapping stroke. It transpires in light of the present invention, however, that such a carry-over in design from manually-operated, hand-held openers is both unnecessary and even more importantly, overtly disadvantageous in that the arcuate path of the anvil during the decapping stroke as above-described has now been found to contribute directly and significantly to the bottle neck chipping caused by automated prior art machines.

Generally, it is a feature of the present invention to reduce the incidence of chipping damage to bottle necks during the bottle decapping operation.

It is a further object of certain embodiments of the present invention to provide a simple, relatively low-cost, decapping apparatus.

SUMMARY OF THE INVENTION

In accordance with one aspect of the present invention, therefore, there is provided an automated decapping machine operable to decap capped bottles and including a pivotable lever arm bearing a decapping anvil adapted to move along an arcuate path between first and second positions and in so doing contacting a peripheral edge of a bottle cap and deforming the depending skirt thereof to thereby decap the said capped bottles, wherein the improvement comprises: arranging the pivotable lever and anvil to move relative to a capped bottle when same is sheared in decapping relation with the machine such that the said arcuate path of said anvil is arcuately divergent relative to the longitudinal axis of symmetry of the so-positioned capped bottle during the decapping stroke.

The "decapping stroke" is to be defined herein as that transit along the arcuate path by the anvil between its first and second positions during which the bottle decapping operation is actually performed. It is contemplated that many embodiments of the present invention will entail a reciprocal motion of the anvil between its first and second positions. In such embodiments the anvil will traverse the arcuate path from its first to its second positions during the "decapping stroke" and, following completion of a decapping operation, the anvil will then return from the second position to the first by way of a "return stroke".

The term "anvil means" is used herein in its broadest possible sense to include any appliance, be it a hook, prong, or even a simple extension of the lever that will serve in the context of the present invention to engage a peripheral portion of the cap's depending skirt and deform that skirt to at least the extent required to release the cap from secured frictional engagement with the bottle.

In accordance with another aspect of the present invention there is provided a method for decapping bottles comprising the steps of: contacting an anvil in a first position with a peripheral portion of the depending skirt of a bottle cap which is secured in frictional engagement with a bottle; and, moving said anvil while maintaining contact between said anvil and said cap along an arcuately divergent path relative to the longitudinal axis of symmetry of the capped bottle to a second position wherein said cap is freed by said anvil from secured frictional engagement with the bottle.

In accordance therefore with yet another aspect of the present invention, there is provided a bottle decapping machine adapted to receive capped bottles and operable to decap bottles so received wherein the novel machine comprises a decapping station in which individual bottles are securely positionable in bottle decapping relation with an assembly comprising a lever arm rotatable, by means selected for that purpose, about a pivot. Anvil means is secured to the lever arm in spaced apart relation from that pivot. The assembly is located relative to the station such that on rotation of the arm about the pivot, the anvil means is moveable from a first position below but vertically aligned with a peripheral portion of the cap, to a second position along an arcuately divergent path relative to the longitudinal axis of symmetry of the bottle whereby, during the anvils traverse of that path between the first and second positions, the anvil contacts the peripheral edge of the bottle cap and frees the cap from secured frictional engagement with the bottle.

The pathway travelled by the anvil in the above-described machine has, surprisingly, been found to significantly reduce bottle chipping damage occasioned during the decapping operation. Moreover, the amount of divergence of the arcuate pathway from the above-mentioned centre line need only be slight in absolute dimensional terms in order to produce a significant reduction in chipping.

The simplicity underlying the above-described machine's operation lends itself advantageously to a corresponding simplicity of design. On the subject of capital costs, it will be appreciated that simplicity of design can be translated directly into reduced costs for building the machine. Maintenance costs are reduced mainly because there are fewer and less complex parts to look after and also because downstream damage to, for example, the sealing washers of automatic filling equipment is reduced due to the lower incidence of bottle neck chipping. Operating costs are reduced both by virtue of the fact that design simplicity can render a machine operator unnecessary and because only a relatively small number of bottles are damaged as a consequence of the machine's operation. Moreover, operating costs are further reduced since the statistical reduction in the amount of damage to bottle necks reduces the probability of additional downstream quality control problems of the variety which are exacerbated by bottle neck damage.

DETAILED DESCRIPTION

Figure 1:
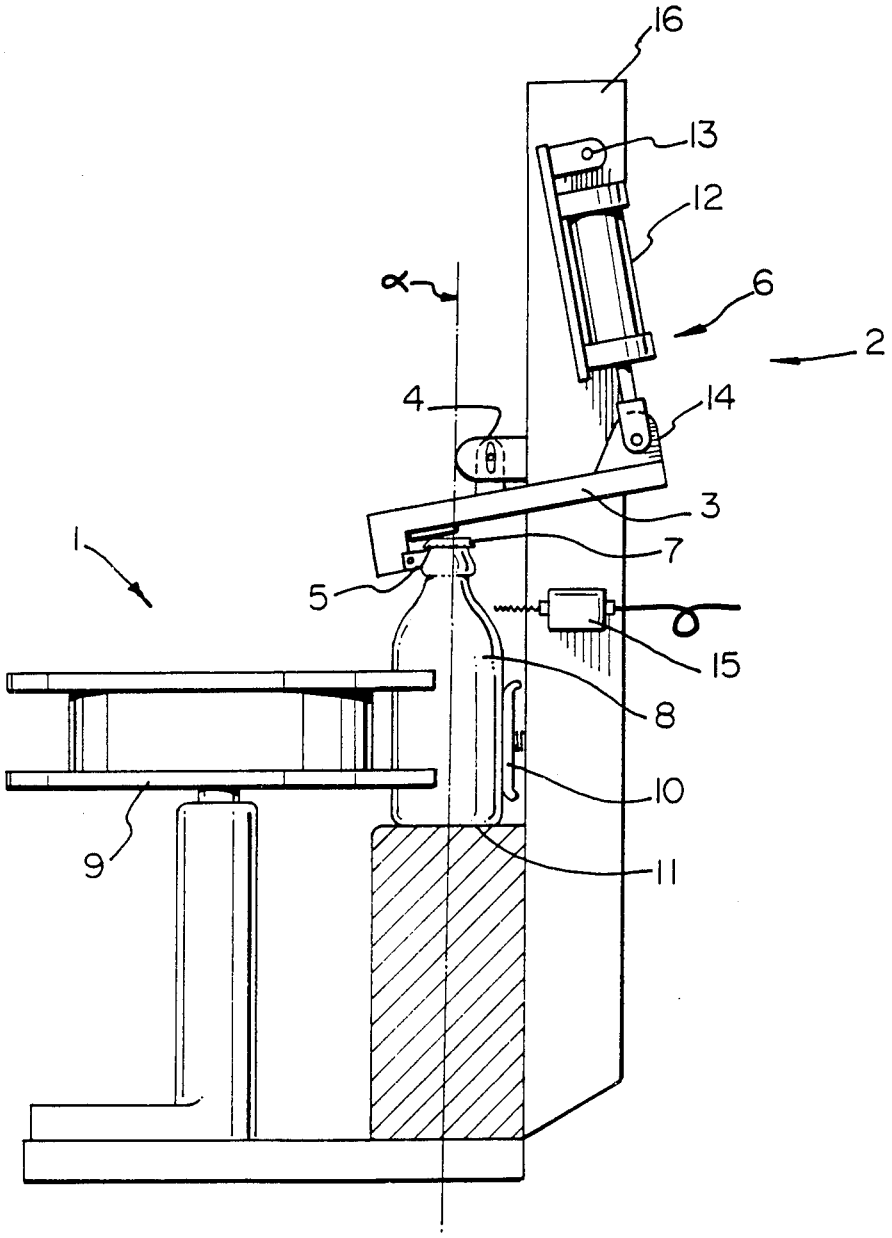
FIG. 1 depicts a preferred bottle decapping machine of the present invention.
Figure 1A:
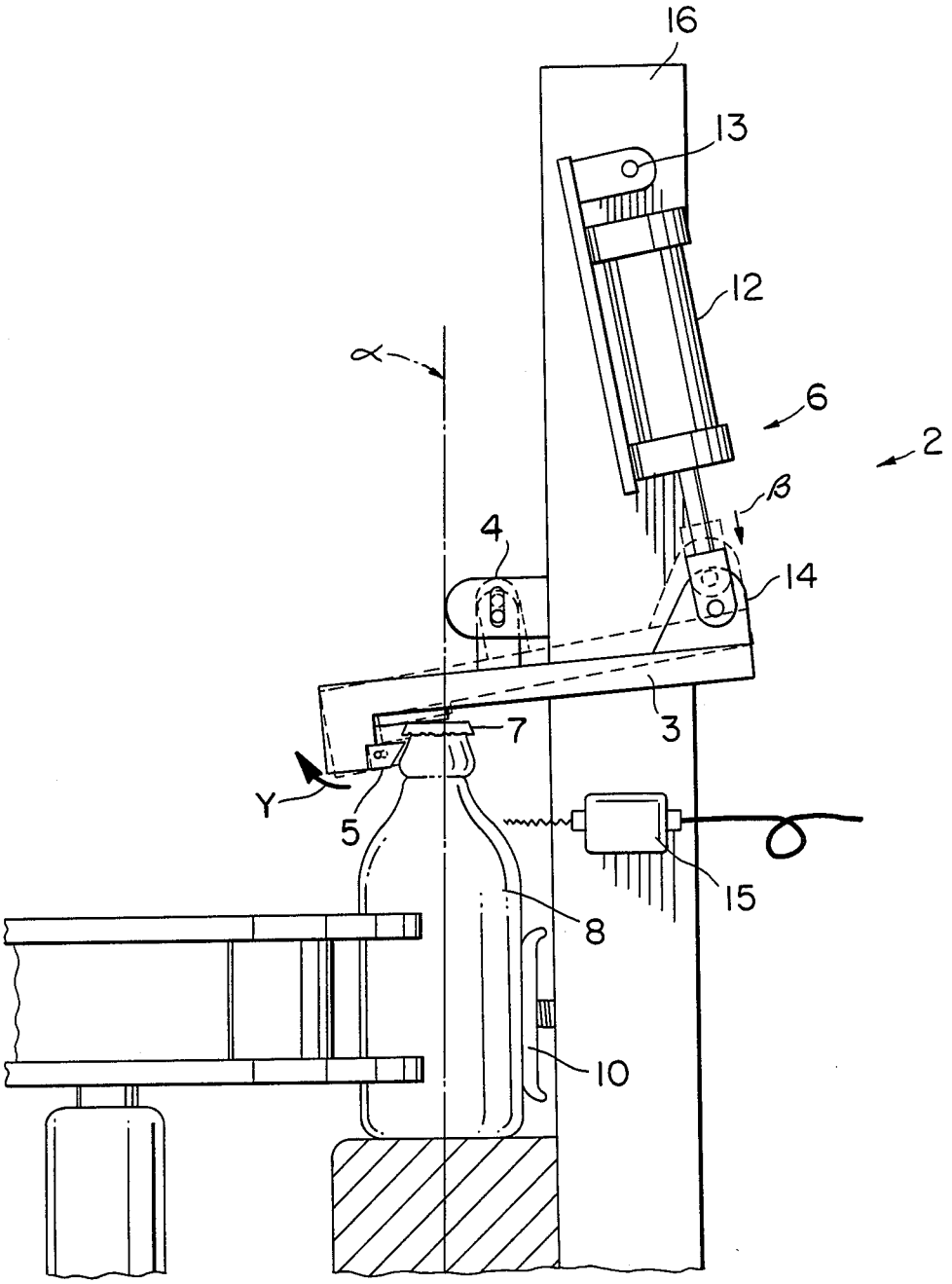

Virtually any bottle decapping station wherein individual bottles can be securely positioned in the manner set out in the 'Summary of tne Invention' above, can be used in the practice of the present invention. However, since the bottle decapping assembly operates with such elegant simplicity, it is possible, and having regard for the cost advantages, preferable, to employ a decapping station of comparable simplicity. Indeed, in a preferred form, the bottle decapping station is mechanically independent from the decapping assembly. This avoids the substantial costs associated with indexing chains or gears as well as repair/replacement and other maintenance costs which are necessarily entailed by complex indexing apparatus. In such an arrangement the decapping assembly is operated directly in response to a bottle being positioned in decapping relation therewith. As an example of an especially preferred form of this arrangement, the decapping station comprises a free-wheeling star wheel operating in conjunction with a resiliently biased fence arranged in suitable, mutually spaced apart relation to one another on opposite sides of the in-coming, single-file pathway of capped bottles. A star wheel is a common piece of apparatus in the bottled beverage industry and consists generally of one or more disks, the circumferences of respective ones of which are tooled or cast to provide semi-circular, radially inwardly extending pockets suitable for capturing individual in-coming bottles. As used in a decapping station of the present invention, a freely rotatable star wheel is positioned to one side of an in-coming, single-file bottle pathway, directly opposite a resiliently biased bottle fence which extends from an upstream location, in a downstream direction at an angle across said pathway, and generally towards the star wheel. In operation, the individual bottles are trapped between the fence and respective ones of the indentations arrayed about the circumference of the star wheel, as the star wheel is rotated by the on-coming supply of succeeding bottles. The fence is deflected by the captured bottle's passage along the bottle pathway, but being resiliently biased towards the star wheel, the fence urges the captured bottle into secured contacting relation with the associated pocket on the star wheel and thus establishes the secured relationship necessary to the aforementioned decapping function. With the captured bottle securely positioned in this manner, the decapping assembly can be operated to decap the bottle in the manner summarized above.

In such a preferred configuration the decapping assembly can be operated in direct response to the bottle being appropriately and securely positioned by utilizing switch means for detecting the presence of a bottle so positioned. For example, a limit switch having an actuator arm arranged in such a way as to be deflected by a properly positioned bottle can then close the circuit that activates the selected lever arm rotating means, which in turn would rotate the lever arm of the decapping assembly about the pivot thereof.

The decapping assembly is preferrably formed of a pivotable arm and an attached anvil. Clearly these two functional elements can be provided for by a single unitary structure wherein the anvil is merely a co-jointly formed extension of the lever arm. In a preferred form, however, the lever arm is constructed of a relatively light and/or inexpensive material such as, for example, cast aluminum. Preferably, the anvil in such circumstances is preferably formed of, for example, a hardened tool steel or like material, and is suitably joined to the lever arm.

The spaced apart relationship between the anvil and the pivot determines the radius and hence, the curvature of the anvil's path when the lever arm is rotated about that pivot. The family of curves which are operable for any given combination of bottle and cap are those in which the lateral displacement of the anvil away from the bottle's longitudinal centre line does not remove the anvil from contacting relation with the cap at least over that portion of the arc between and including the aforementioned first and second positions and provided always, of course, that the path is not such that the anvil strikes the bottle. Clearly, a longer radius will reduce the path's curvature relative to a shorter radius. Hence, the former will involve substantially less lateral displacement of the anvil than will the latter.

In a preferred form, the assembly comprises an elongated lever arm extending from the pivot, which is located above and to one side of the bottle, over the top of the bottle to a side thereof opposite the pivot. The lever arm then extends downwardly at right angles from the first portion thereof, to a height slightly below the height at which the bottle cap's periphery is oriented when a capped bottle is securely positioned as aforementioned. The anvil then extends generally at right angles to the second portion of the lever arm, and is thereby disposed in its above-mentioned first position. The advantages of this particular arrangement are that it permits the lever arm to be lengthened which in turn results in the curvature of the arc being reduced, without the decapping assembly having to occupy any additional horizontal space to the side of the bottle conveyor. Moreover, the presence of the lever arm above the bottle to be decapped will, in the event of accidental release of the bottle from its secured position during the decapping operation, prevent the catapulting of the bottle into the air.

Another preferred feature of the present invention can be achieved by arranging the lever arm pivot in a vertically extending slot. This arrangement will permit the lever arm to float from bottle top to bottle top and to thereby accommodate minor variations in the heights of individual bottles.

Moreover, the assembly as a whole may be adapted to be vertically adjustable relative to the bottle decapping station to thereby accommodate different sizes of bottles.

DETAILED DESCRIPTION OF THE PREFERRED EMBODIMENT

FIG. 1(*a*) depicts the preferred bottle decapping machine of FIG. 1 with movable elements depicted in two positions.

In accordance with the preferred embodiment of the present invention there is provided a bottle decapping machine as shown in FIG. 1 which is adapted to receive capped bottles and operable to decap bottles so received. This machine comprises a decapping station 1 wherein individual capped bottles are securely positionable in bottle decapping relation with a bottle decapping assembly 2. The bottle decapping assembly comprises a lever arm 3 which is rotatable about a lever arm pivot 4, an anvil 5 secured to the lever arm 3 in spaced apart relation from the pivot 4 and means 6, operable to rotate lever arm 3 about lever arm pivot 4. The assembly 2 is located relative to station 1 such that on rotation of the lever arm 3 about the the pivot 4 by means 6, the workpiece engaging portion or anvil 5 is moveable from a starting or first position slightly below but vertically aligned with a peripheral portion of a cap 7 borne in secured frictional engagement on a capped bottle 8, when said bottle 8 is securely positioned at decapping station 1, to a second position above said first position and lying along an arcuately divergent path from the longitudinal axis of symmetry of bottle 8 when bottle 8 is securely positioned at the decapping station. During the traverse of said path by anvil 5, the anvil contacts the peripheral edge of cap 7, deforming the depending skirt thereof so as to lever cap 7 out of secured frictional engagement with bottle 8.

More specifically, means 6 of assembly 2 comprises a pneumatic cylinder 12, an upper cylinder pivot 13, a lower cylinder pivot 14, a proximity switch 15 and an upwardly extending frame member 16. Means 6 is operable by way of proximity switch 15 which detects the presence of successive bottles 8 when properly positioned in decapping station 1 and in response to bottles so positioned actuates pneumatic cylinder 12. In response thereto, cylinder 12 exerts a force between upper cylinder pivot 13 which is pivotably fixed to frame member 16 and lower cylinder pivot 14 which is pivotably attached to lever arm 3 in spaced apart relation from both pivot 4 and anvil 5. The force exerted by cylinder 12 is translated into a pivoting motion of lever arm 3 about pivot 4 whereupon anvil 5 is moved between first and second positions as described in the preceding paragraph.

Decapping station 1 comprises a freely rotating star wheel 9, a bottle conveyor 11 and a spring-loaded fence plate 10. Bottle conveyor 11 is operable to bring succeeding bottles 8 into position at bottle decapping station 1 wherein bottle 8 is securely positioned between star wheel 9 and spring-loaded fence plate 10.

FIG. 1(*a*) details the mechanical action that is inherent in the operation of the device depicted in FIG. 1.

In operation, the pneumatic cylinder 12 extends during the decapping stroke (as indicated by the arrow shown at "B") between upper cylinder pivot 13 and lower cylinder pivot 14. This extensions acts through the lower cylinder pivot 14 to impart a clockwise rotation to lever arm 3. Note that in FIG. 1, the lever arm 3 rests (or "floats") on the upper most surface of the bottle cap 7, whereby the lever arm pin is positioned above the lower limit of the slot of the lever arm pivot 4. Accordingly, in the depicted embodiment, the initial rotation of the lever arm 3 takes place around a centre defined by a point of contact between lever arm 3 and the bottle cap 7. This initial rotation continues until the lever arm pin seats against the lower limit of the slot. Thereafter, and throughout the balance of the decapping stroke, the continuing clockwise rotation of lever arm 3, (in response to the further extension of cylinder 12), is centered about lever arm pivot 4. The concomitant motion that is imparted by both the initial and continuing rotation of lever arm 3 causes anvil 5 to traverse a path (see Y) which is arcuately divergent from the axis of symmetry alpha, throughout the decapping stroke or, in other words, at least until the anvil reaches the second position in which the anvil disengages bottle cap 7 from its formerly secured frictional engagement to bottle 8.

I claim:

1. A decapping machine adapted to receive capped bottles and operable to decap bottles so received, said machine comprising:

a decapping station wherein individual capped bottles having peripheral edges are securely positionable in bottle decapping relation with an assembly comprising a lever arm rotatable about a pivot, anvil means secured to said lever arm in spaced apart relation from said pivot, said lever-arm-rotating means operable to rotate said lever arm; said assembly being located relative to said station such that on rotation of said arm about said pivot by said lever-arm-rotating means, said anvil means is moveable from a first position wherein said anvil means contacts said peripheral edge, along a divergent, arcuate path relative to the longitudinal axis of symmetry of said bottle, when said bottle is securely positioned at said decapping station, to a second position whereupon said anvil urges said cap out of secured frictional engagement with said bottle and wherein said lever arm comprises first and second portions, said first portion extending from said pivot at a height above said decapping station sufficient to permit successive, individual capped bottles to be positioned at said decapping station beneath said first portion, said first portion further extending beyond said capped bottles when so positioned, to a side thereof substantially diametrically opposite said pivot where said first portion terminates in said second portion extending generally downwardly from said first portion and being adapted to receive said anvil means in mutually secured relation therewith, said pivot being a vertically slotted pivot adapted to accommodate minor variations in the individual heights of successive capped bottles such that said first portion of said lever arm is adapted to float from top to top of each succeeding capped bottle positioned at said decapping station.

2. The decapping machine of claim 1 wherein said first position is established to be slightly below but vertically aligned with a peripheral portion of a cap borne in secured frictional engagement on a capped bottle when said bottle is securely positioned at said decapping station.

3. The decapping machine of claim 1 wherein said decapping station is mechanically independent from the decapping assembly.

4. The decapping machine of claim 3 wherein said decapping station comprises a free-wheeling star wheel and a resiliently biased bottle fence arranged in mutually spaced apart relation on opposite sides of a single file conveyor adapted to deliver capped bottles to said decapping station, said bottle fence extending from an upstream location in a downstream direction at least part way across said conveyor and generally towards said star wheel.

5. The decapping machine of claim 1 wherein said lever arm rotating means is operable by switch means directly responsive to the presence of capped bottles securely positioned at said decapping station.

6. The decapping machine of claim 1 wherein the position of said decapping assembly relative to said decapping station is vertically adjustable.

* * * * *